United States Patent [19]

Peterson

[11] Patent Number: 4,613,192

[45] Date of Patent: Sep. 23, 1986

[54] POWER CORD STRAIN RELIEF

[75] Inventor: Donald E. Peterson, Mansfield, Ohio

[73] Assignee: The Tappan Company, Mansfield, Ohio

[21] Appl. No.: 750,919

[22] Filed: Jul. 1, 1985

Related U.S. Application Data

[63] Continuation-in-part of Ser. No. 570,791, Jan. 16, 1984, abandoned.

[51] Int. Cl.[4] ..... H01R 4/66; H01R 13/56

[52] U.S. Cl. ..... 339/14 P; 339/105

[58] Field of Search ..... 339/75 P, 101, 103 B, 339/14 R, 14 P, 147 R, 147 P, 159 C, 105

[56] References Cited

U.S. PATENT DOCUMENTS

| | | | |
|---|---|---|---|
| 3,060,293 | 10/1962 | Lapidus | 339/159 C |
| 3,381,258 | 4/1968 | Becker | 339/14 P |
| 3,706,066 | 12/1972 | Shroyer | 339/75 P |
| 4,307,925 | 12/1981 | Drew | 339/147 P |

FOREIGN PATENT DOCUMENTS

| | | | |
|---|---|---|---|
| 106891 | 8/1979 | Japan | 339/75 P |
| 2072436 | 9/1981 | United Kingdom | 339/147 P |

*Primary Examiner*—Gil Weidenfeld
*Assistant Examiner*—Gary F. Paumen
*Attorney, Agent, or Firm*—Alfred E. Miller

[57] ABSTRACT

A strain relief for a power cord for electric devices includes a molded insulating body into which the power cord extends, a grounding lug extending from another side of the body and connected to the ground lead of the power cord. Grooves are provided in the sides of the body to enable the body to be assembled in a slot of the electric device, with the grounding lug of the strain relief adjacent a wall of the electric device, so that the grounding lug may be held to the wall of the device by a screw. The grounding lug may be used to function as a strain relief or auxiliary metal may be provided as a retainer. Connectors extending from the device on the portion opposite the grounding lug are adapted to be connected to leads within the electric device, the connectors being, for example, spade lugs. A fault sensing device such as an automotive fuse may be coupled to additional connectors on the body.

17 Claims, 22 Drawing Figures

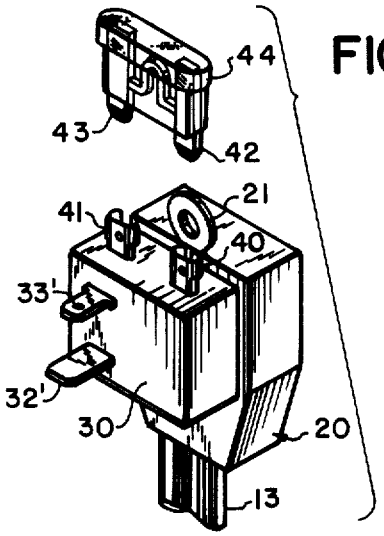
FIG.9
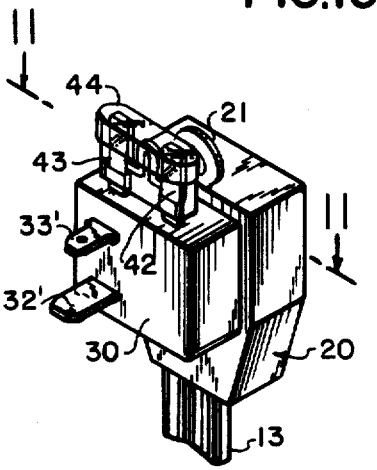
FIG.10
FIG.11
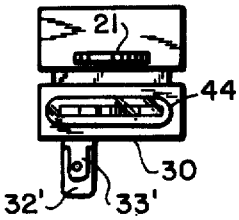
FIG.12
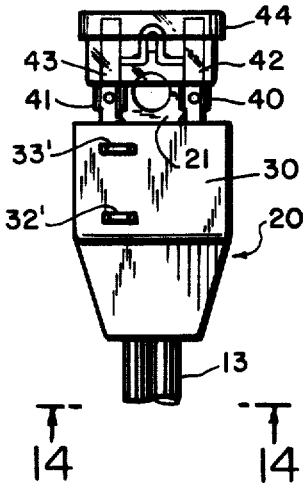
FIG.13
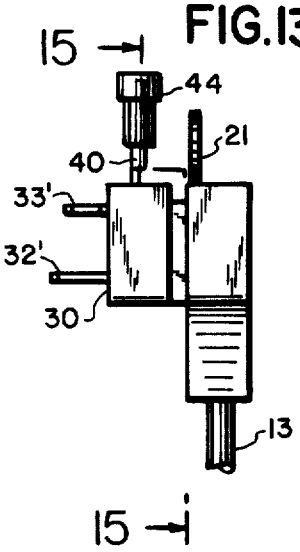
FIG.14
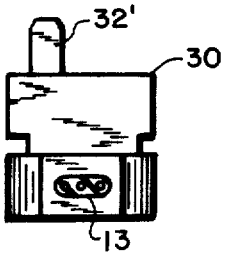
FIG.15
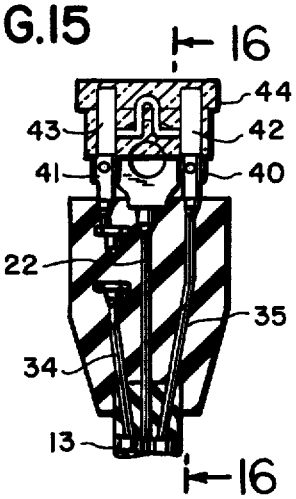
FIG.16
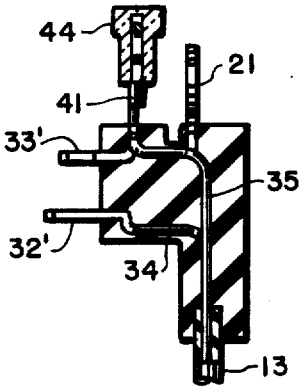

FIG. 19
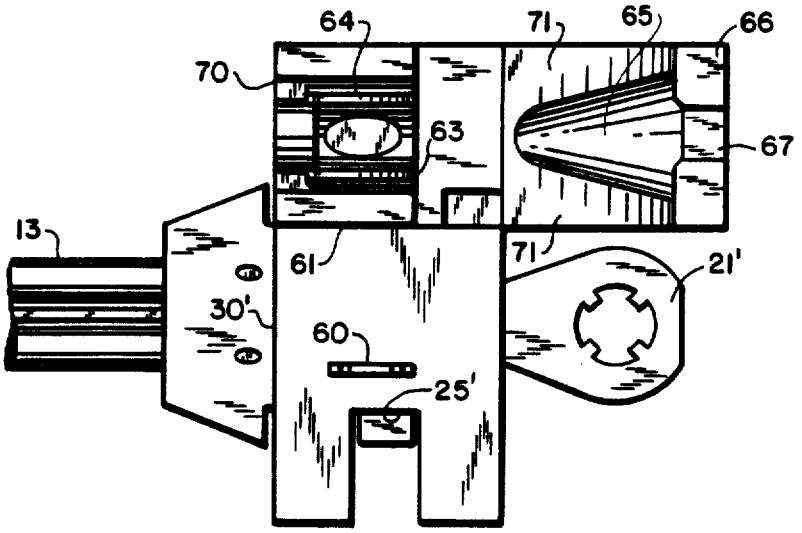
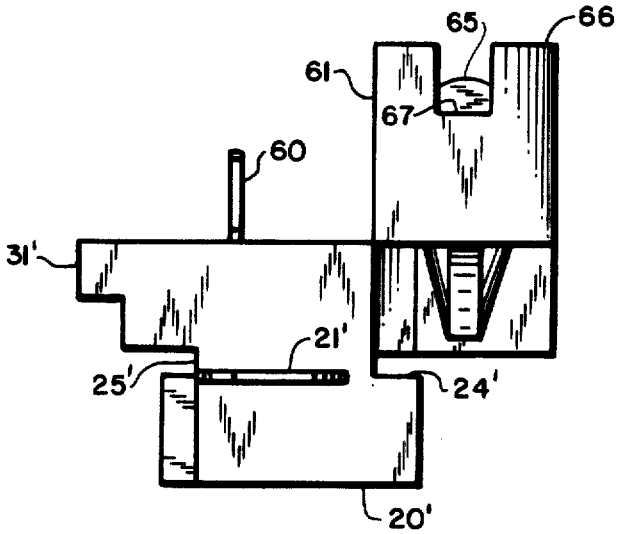
FIG.20

POWER CORD STRAIN RELIEF

This application is a continuation-in-part of my application Ser. No. 570,791, filed Jan. 16, 1984, and now abandoned.

This invention relates to arrangements for inhibiting the passage of strain, on a power cord, from the internal elements of a device cord by the power cord.

While power cord strain relief of the invention is described specifically with respect to use on a microwave oven, it is of course apparent that the invention is not limited to this application of the relief device, the relief device being readily adaptable to other electric appliances and electric devices.

In one type of strain relief device for a power cord, a plastic bushing is arranged to be fit around the cord and snapped or otherwise held in an enlarged hole in an external wall of the device powered by the cord. Closing of the bushing forms a slight bend in the cord so that it cannot be withdrawn through the bushing. In power cord relief assemblies of this type, the wires of the cord must extend into the device for interconnection at the proper location, and the assembly thereof requires the steps of encircling the cord with the bushing at the proper distance from the end thereof, inserting the cord and bushing into the hole in the device, compressing the bushing to snap it into place, and then feeding the wires in the device to the proper location and connecting them. This latter step would of course be done in a manner to avoid interfering with other components of the device, especially if the wires terminate at some distance from the relief, or to couple the power cord to the device at an early stage in the assembly.

In another form of strain relief, as disclosed in U.S. Pat. No. 4,272,645, a strain relief enlargement is molded on the power cord at the proper location from its end, the elargement being especially configured and elastic to enable it to be forced into a specially designed aperture in the device, by a special tool. In the arrangement of this reference, the wires of the power cord extend directly into the device for connections at locations which may be remote from the entry point thereof.

The present invention is directed to the provision of an easily produced power cord strain relief arrangement which simplifies the installation thereof, as well as minimizing the effort and expense required to protect the device from excess current or other faults within the appliance.

SUMMARY OF THE INVENTION

Briefly stated, in accordance with the invention, these objects are achieved by providing a power cord having an enlarged molded extremity on one end thereof. The power cord extends into the molded end, and is attached to spade lugs projecting from the plug for interconnection within the electrical device. The molded end is provided with a pair of parallel grooves or the like on opposite sides thereof, to enable it to be slid into a slot in, for example, a metal panel of an appliance. Preferably, such panel is arranged in the electrical device to have its slot covered by a further element, such as another panel in subsequent assembly steps, to inhibit removal of the mounted end from the slot. In addition, a laterally extending lug extends generally parallel to the plane of the grooves of the molded end, the lug having a hole enabling the firm interconnection of the lug with the panel by means of a screw or the like.

This lug is preferably coupled to the ground wire of the power cord, thereby enabling grounding of the device in a simple and effective manner.

In further embodiments of the invention, further spade lugs may be provided for connecting a fault sensor thereto, in order to interrupt the current spade lugs in the event of excess current. This feature serves to protect the device in a simple manner, without the necessity of providing further arrangements, such as fuses in the electrical appliance.

BRIEF FIGURE DESCRIPTION

In order that the invention will be more clearly understood, it will now be disclosed in greater detail with reference to the accompanying drawings, wherein:

FIG. 9 is an exploded view of a further modification of a strain relief in combination with a fault sensor;

FIG. 10 is a perspective view corresponding to FIG. 9, with the fault sensor connected to the strain relief;

FIG. 11 is an end view of the strain relief of FIG. 10;

FIG. 12 is a bottom view of the strain relief of FIG. 10;

FIG. 13 is a side view of the strain relief of FIG. 10;

FIG. 14 is a view of the strain relief of FIG. 10 from the side to which the cable is connected;

FIG. 15 is a cross sectional view of the strain relief of FIG. 10 taken along the lines 15—15 of FIG. 13;

FIG. 16 is a cross sectional view of the strain relief of FIG. 10 taken along the lines 16—16 of FIG. 15.

FIG. 19 is a top view of the strain relief of FIG. 17;

FIG. 20 is an end view of the strain relief of FIG. 17,

DETAIL DISCLOSURE OF THE INVENTION

Figure 1:
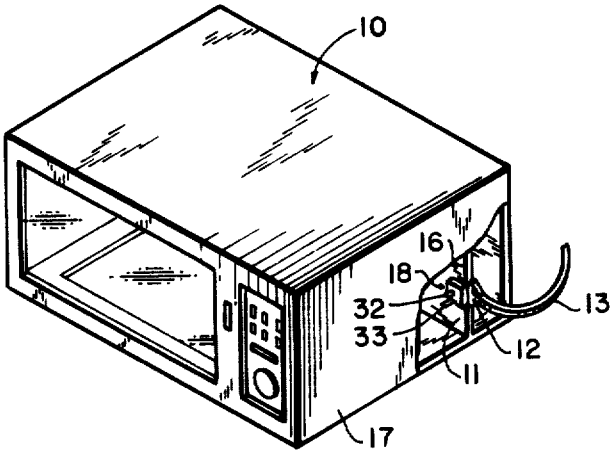
FIG. 1 is a perspective view of a microwave oven, one side being cut away to show the use of the strain relief of the invention.
Figure 2:
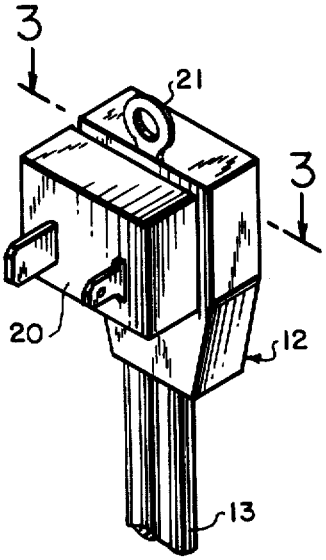
FIG. 2 is a perspective view of one embodiment of a strain relief in accordance with the invention.
Figure 3:
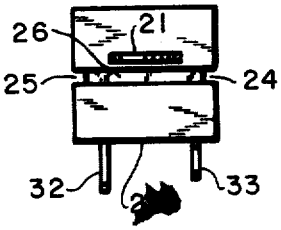
FIG. 3 is an end view of the relief of FIG. 1.
Figure 4:
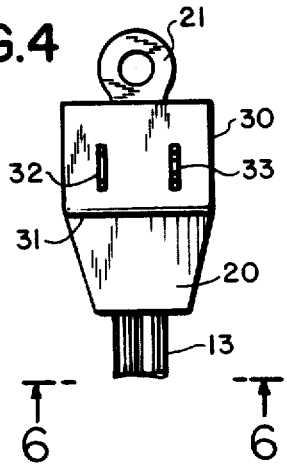
FIG. 4 is a bottom view of the strain relief of FIG. 2.
Figure 5:
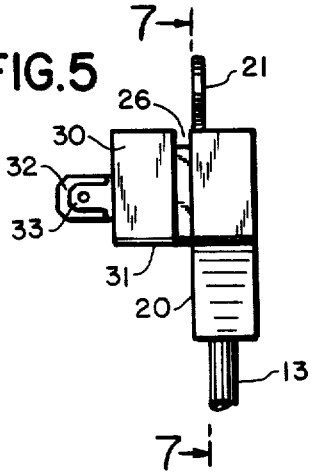
FIG. 5 is a side view of the strain relief of FIG. 2.
Figure 6:
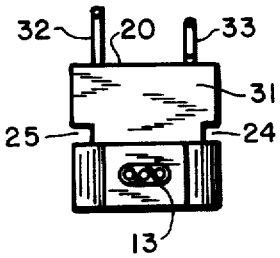
FIG. 6 is a view of the strain relief of FIG. 2 taken from the side from which the cord thereof extends.
Figure 7:
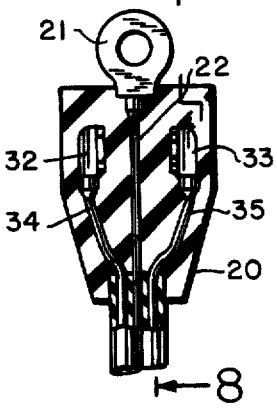
FIG. 7 is a cross section of the strain relief of FIG. 1 taken along the lines 7—7 of FIG. 5.
Figure 8:
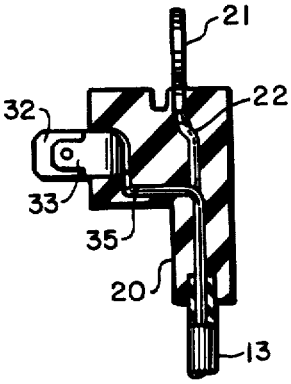
FIG. 8 is a cross sectional view of the strain relief of FIG. 2 taken along the lines 8—8 of FIG. 7.

FIG. 1 illustrates a microwave oven 10 having a wall 11. The wall 11 may be an interior wall as illustrated, or it may be an exterior wall. A parallel sided slot (not shown) is provided in the wall from receiving a power cord strain relief device 12 in accordance with the invention. A line cord 13 extends from the strain relief 12 externally of the oven, the strain relief having a pair of spade connectors 32 and 33 adapted to receive conventional connectors for applying power to internal systems in the oven. The edge 16 in which the slot for receiving the strain relief extends may be adapted, in a final assembly of the microwave oven, to abut another wall, such as external wall 17 of the microwave oven, thereby to inhibit removal of the strain relief from the slot. In addition, a hole 18 in the wall 11 is shown at the end of the slot to receive a screw extending through a grounding lug of the strain relief, thereby to ground the microwave oven as well as to further inhibit release of the power relief from the microwave oven.

While the strain relief in accordance with the invention has been illustrated in use in a microwave oven, it is apparent that the strain relief may be employed similarly in other electrical appliances and devices, within the scope of the invention. In the embodiment of the strain relief of the invention illustrated in FIGS. 2 through 8, the strain relief has an insulating body 20, for example of molded rubber or plastic. The power cord 13 extends into one end of the body portion 20. A grounding lug 21 is molded to extend out of the body 20 and is connected internally of the body 20 to the grounding wire 22 of the three wire power cord 13.

The body 20 has a pair of parallel grooves 24, 25 on opposite sides thereof, in a plane just adjacent the plane of the grounding lug 21, the grooves 24, 25 being joined by a groove 26 at the end of the body 20. The grooves 24, 25 are adapted to receive the sides of the slot in a sheet metal wall of the appliance, the end groove 26 thereby engaging the end of such slot. Since the grooves 24–26 are adjacent the grounding lug 21, the grounding lug 21 may be readily aligned with a suitable hole in the appliance as well as holding the strain relief firmly in the appliance.

The portion 30 of the body on the opposite side of the grooves 24–26 from the grounding lug 21 has a surface 31 toward the power cord 13 that is in a plane perpendicular to the plane of the slots and the axis of the power cord as it enters the strain relief. This planar surface 31 is positioned to be generally in line with the open end of the slot into which the strain relief is inserted, so that the surface 31 may abut a further sheet metal wall later assembled in the appliance, to further hold the strain relief in position.

A pair of spade lugs 32, 33 extend from the side of the portion 30 of the body 20, these spade lugs being internally connected to the wires 34, 35 respectively of the power cord. The spade lugs 32, 33 are hence adapted to be connected to the internal components of the appliance by conventional connectors. The spade lugs might also be wires or other devices to engage the external electrical circuit.

In the modification of the invention illustrated in FIGS. 9–16, the strain relief in accordance with the invention is also readily adapted to protect the components of the appliance from excess current. In this embodiment, a pair of connectors 40, 41 are provided on surface 30 of the body 20 opposite the power cord 13. The connectors 40, 41 are adapted to receive the spade lugs 42, 43 respectively of a fault sensor device 44, such as an automotive type fuse. In this embodiment of the invention the line 35 on the power cord is connected internally of the body 20 to the connector 40, the connector 41 being connected internally of the body portion 30 to the spade lug 33'. The other power cord connector 34 is connected internally of the body 20 to the spade lug 32'. The spade lugs 32' and 33' or other devices are hence adapted to be connected internally of the appliance to the electrical components thereof.

While the fault sensor 44 serves to protect the components of the appliance by interrupting the current from the power cord, for example by the melting of a fusible element, the fault sensor is located completely internally of the appliance and is hence not adapted to be changed by the user of the appliance upon the occurrence of a fault. Since the fault sensor is hence not exposed, it may be designed primarily from the standpoint of the current at which the fusible element will open. The operating voltage of the appliance need not be a prime consideration, as in the case of conventional appliance fusing devices. It is for this reason that conventional automotive type fuses, designed for low voltage, may be economically employed for the fault sensor.

It is of course apparent that the connectors 40, 41 for receiving the spade lugs of an automotive type fuse will be replaced by connectors for receiving cartridge fuses or the like, and that the location for the connectors for such fault sensing devices may be disposed elsewhere on the portion 30 of the body 20.

In the modification of the invention illustrated in FIGS. 17–22, the power cord 13 extends into one end of the insulating body part 20', longitudinal grooves 24' and 25' extending between the body part 20' and the insulating body part 30', as in the previous examples of the invention. Similarly, the grounding lug 21' extends from the end of the body part 20' opposite the end receiving the power cord, adjacent to and parallel to the longitudinal plane defined by the grooves 24', 25'. The grounding lug 21' is internally connected to the grounding wire 22 of the power cord.

The structure is thus adapted to be mounted in a panel, with the sides of a split of the panel extending through the grooves 24', 25', with the grounding lug 21' abutting one side of the panel and held thereto by a suitable screw (not shown). One spade lug 60 is provided on the body portion 30' in a direction generally perpendicular to the plane defined by the grooves 24', 25', this spade lug being internally connected to the wire 34 of the power cord. The insulating body portion 30' further has a planar surface 31' perpendicular to the plane of the grooves 24', 25', on the side thereof toward the power cord, for abutting a panel of the appliance, as in the previously described arrangements.

Figure 17:
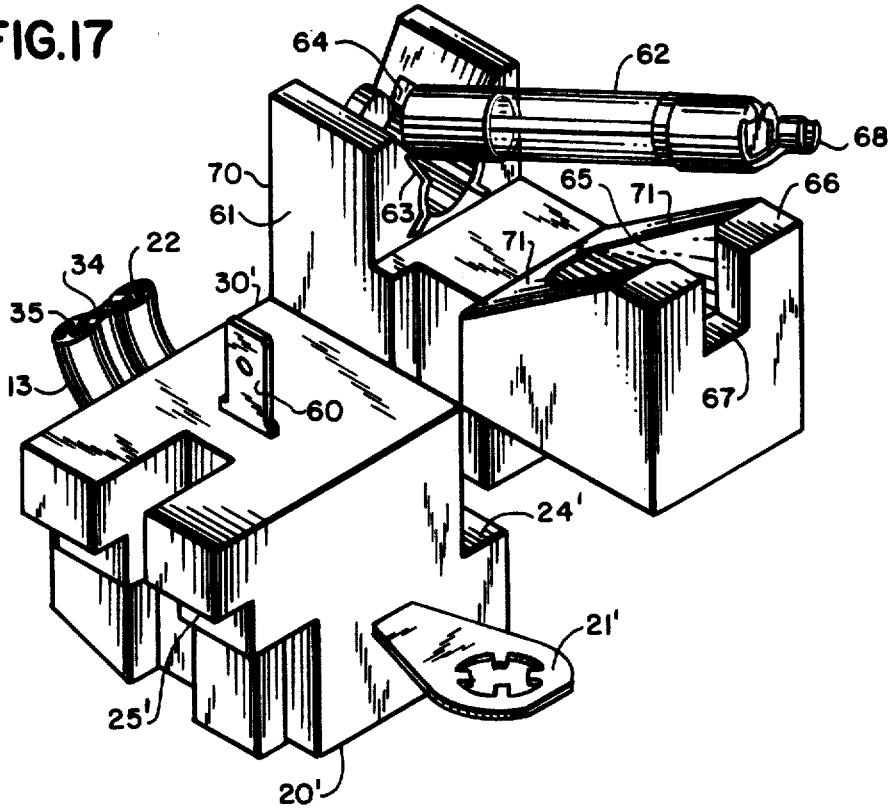
FIG. 17 is a perspective view of another modification of a strain relief in accordance with the invention in combination with a fault sensor.
Figure 18:
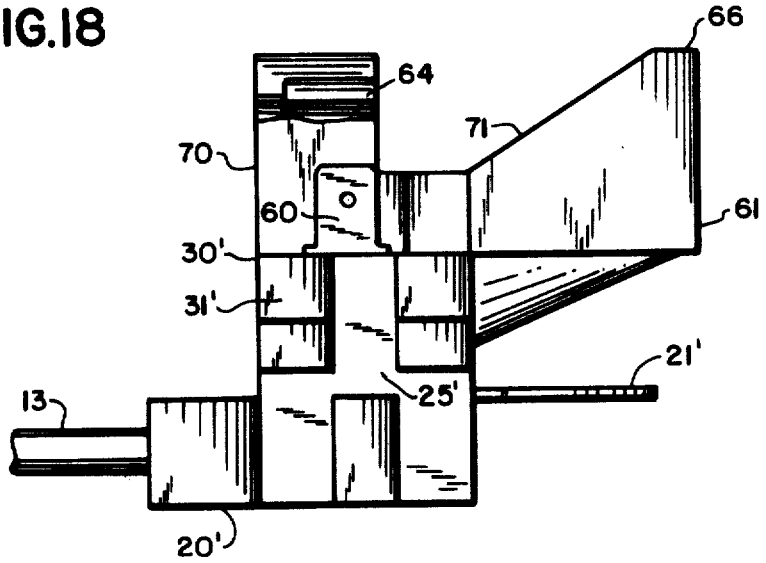
FIG. 18 is a side view of the strain relief of FIG. 17.
Figure 21:
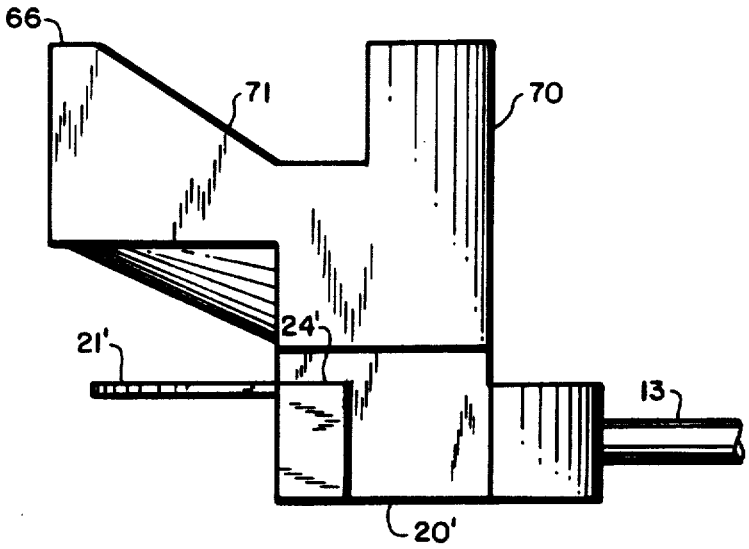
FIG. 21 is a view of the side of the strain relief of FIG. 17 opposite that of FIG. 18.
Figure 22:
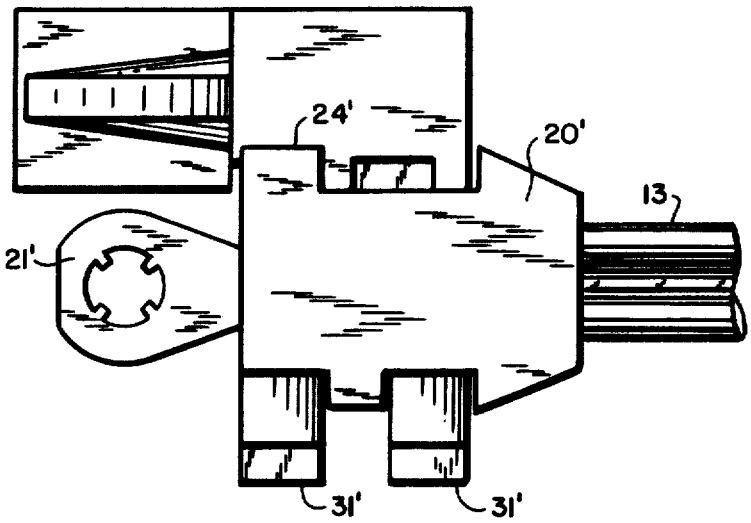
FIG. 22 is a bottom view of the strain relief of FIG. 17.

The body portion 30' further includes an insulating body portion 61 for receiving a fault sensor in the form of a cylindrical fuse 62 illustrated in dashed lines in FIG. 17. In order to retain the cylindrical fuse 62, a fuse clip 63 of conventional type, for example having a pair of opposed contact clip members 64 for receiving one end of a cylindrical fuse, is mounted on the body portion 61, with the clip members 64 being internally connected to the wire 35. The fuse clip 63 is preferably mounted to receive the cylindrical fuse in a direction perpendicular to and toward the plane of the grooves 24', 25'.

The other end of the cylindrical fuse is adapted to be received in a recess 65 spaced from the fuse clip, whereby the installed fuse lies generally parallel to the plane of the grooves 24', 25'. The recess 65 may be defined by an end wall 66 having a notch 67 extending therethrough longitudinally of the cylindrical fuse, for receiving a connection clip 68 affixed to the respective end of the fuse. The connection clip may be comprised, for example, of a clip adapted to be snapped or pushed on the end of the fuse, and having a soldering junction or wire for interconnection with suitable elements in the appliance. Alternatively, of course, the clip may be adapted to the affixed to the cylindrical fuse in any other conventional manner, or it may consist merely of a wire soldered to the fuse, for interconnection with other circuit elements.

The body portion 61 is suitable structural components for holding the fuse clip spaced from the recess 65, preferably in an insulating manner for example by the provision of insulating portions 70 surrounding the fuse clip. The recess 65 may be defined in part by short side walls 71 reinforcing the end wall 66.

In operation, when it is necessary to remove or replace the cylindrical fuse 62, it may be grasped to pull the free end thereof, i.e. the end affixed to the connecter 68, upwardly to pivot in the fuse clip 63, such pivotal removal greatly simplifying the removal of the fuse as compared with conventional cylindrical fuse holders wherein a fuse must be pulled simultaneously from two holders. The connector 68 may thus be removed from the fuse after the fuse has been removed from the strain relief. During assembly, the connector is first fixed to the fuse, and then the cylindrical fuse is snapped into the fuse clip with the other end thereof being pushed into the recess 65.

The present invention thereby provides a strain relief device especially adapted for electrical appliances, wherein the cost of the device and its installation is minimized, while providing ensured grounding of the appliance as well as minimum interference with the internal wiring of the appliance. The strain relief may also advantageously include a fault sensing device for protecting the appliance from over load current.

While the invention has been disclosed and described with reference to a limited number of embodiments, it is apparent that variations and modifications may be made therein, and it is therefore intended in the following claims to cover each such variation and modification as falls within the true spirit and scope of the invention.

What is claimed is:

1. A strain relief for a power cord of an electric device, wherein the power cord has at least three leads, one of which is adapted to be grounded, said strain relief comprising an insulating body into which said power cord extends, a grounding lug extending in a plane from one end of said body and connected to said one lead of said power cord within said body, at least one external groove in said body in a plane adjacent said plane of said grounding lug, for receiving the walls of a slot in said electric device, and a pair of connector means on said body and connected to separate other leads of said power cord within said body, for connecting conductors of said device thereto, said cord extending into the end of said body opposite said one end and in a direction parallel to said plane.

2. The strain relief of claim 1 wherein said body is a molded insulating body.

3. The strain relief of claim 1 wherein said connector means are spade lugs extending from said body.

4. The strain relief of claim 1 wherein said power cord extends into said body and said ground lug extends from the opposite end thereof on the same side of said grooves as said cord.

5. The strain relief of claim 4 wherein said one external groove extends on said body between said ends, and further comprising a second external groove parallel to said one groove on the side of said body opposite thereto and also adjacent to the plane of said lug, said connector means extending from the portion of said body on the side of said grooves opposite said grounding lug.

6. The strain relief of claim 5 further comprising an additional groove interconnecting said one and second grooves and adjacent to the plane of said grounding lug.

7. The strain relief of claim 5 wherein the portion of said body on the side thereof from which said connector means extend has a planar surface on the side thereof directed to the end of said body into which said power cord extends.

8. The strain relief of claim 1 wherein one of said connector means comprises a fuse clip for receiving a cylindrical fuse, said body having recessed means spaced from said fuse clip for receiving the other end of a fuse.

9. The strain relief of claim 8 wherein said body further comprising a notch extending into said recess for receiving connecting means for said other end of said fuse.

10. A strain relief for a power cord of an electric device, wherein the power cord has at least three leads, the first of which is adapted to be grounded; said strain relief comprising an insulating body, said power cord extending into one end of said insulating body, a grounding lug extending from the end of said body opposite one end, and connected internally of said body to said first lead of said power cord, first and second parallel grooves in opposite sides of said body extending between said ends and in a plane parallel to and adjacent to the plane of said ground lug, said body having a first portion into which said power cord extends and from which said grounding lug extends, and a second portion on the side of said grooves opposite said first portion, and first and second connector means on said second portion of said body, at least said first connector means being connected to another lead of said power cord.

11. The strain relief of claim 10 wherein said first and second connector means are spade lugs, and said second connector means is connected to a separate other lead of said power cord.

12. The strain relief of claim 10 further comprising third and fourth connector means extending from said second portion, said second and third connector means being connected internally of said body, said third and fourth connector means being adapted to receive fault sensing means, and said fourth connector means being connected to a separate other lead of said power cord.

13. The strain relief of claim 12 wherein said first and second connector means are spade lugs adapted to be connected to said electric device.

14. The strain relief of claim 13 further comprising a fault sensor connected to said third and fourth connector means.

15. The strain relief of calim 14 wherein said fault sensor is an automotive type fuse.

16. The strain relief of claim 10 wherein said connector means extends form said body in a direction normal to the plane of said grooves.

17. The strain relief of claim 10 wherein said second connector means comprises a fuse clip for receiving one end of a cylindrical fuse, said fuse clip being connected to a further lead of said power cord, said second portion of said insulating body further having an insulated recess for receiving the other end of a cylindrical fuse affixed to said fuse clip.

* * * * *